US010641262B2

(12) United States Patent
Inoue

(10) Patent No.: US 10,641,262 B2
(45) Date of Patent: May 5, 2020

(54) DIAPHRAGM PUMP

(71) Applicant: OKENSEIKO CO., LTD., Tokyo (JP)

(72) Inventor: Akira Inoue, Tokyo (JP)

(73) Assignee: OKENSEIKO CO., LTD., Tokyo (JP)

( * ) Notice: Subject to any disclaimer, the term of this patent is extended or adjusted under 35 U.S.C. 154(b) by 142 days.

(21) Appl. No.: 16/011,451

(22) Filed: Jun. 18, 2018

(65) Prior Publication Data

US 2018/0363646 A1 Dec. 20, 2018

(30) Foreign Application Priority Data

Jun. 20, 2017 (JP) ..... 2017-120135

(51) Int. Cl.

| | |
|---|---|
| ***F04B 45/02*** | (2006.01) |
| ***F04B 53/18*** | (2006.01) |
| ***F04B 43/02*** | (2006.01) |
| ***F04B 43/04*** | (2006.01) |
| ***F04B 43/00*** | (2006.01) |

(Continued)

(52) U.S. Cl.

CPC ..... *F04B 45/022* (2013.01); *F04B 35/04* (2013.01); *F04B 43/0045* (2013.01); *F04B 43/026* (2013.01); *F04B 43/04* (2013.01); *F04B 43/043* (2013.01); *F04B 53/18* (2013.01); *F04B 39/0094* (2013.01); *F04B 43/02* (2013.01); *F04B 53/006* (2013.01)

(58) Field of Classification Search

CPC ..... F04B 43/026; F04B 43/04; F04B 43/043; F04B 43/0045; F04B 45/022; F04B 53/18

See application file for complete search history.

(56) References Cited

U.S. PATENT DOCUMENTS 4,801,249 A * 1/1989 Kakizawa ..... A61B 5/0235 417/269
6,206,664 B1 * 3/2001 Kakizawa ..... F04B 43/026 417/569

(Continued)

FOREIGN PATENT DOCUMENTS

CN 2615375 Y 5/2004
EP 2554846 A1 2/2013

(Continued)

OTHER PUBLICATIONS

European Search Report and Written Opinion received for EP Patent Application No. 18177648.5, dated Jul. 25, 2018, 7 pages.

(Continued)

*Primary Examiner* — Peter J Bertheaud

(74) *Attorney, Agent, or Firm* — Womble Bond Dickinson (US) LLP

(57) ABSTRACT

A diaphragm pump (1) includes a driving body (33) configured to convert a rotation of a crank body (31) into a reciprocal motion and transmit the reciprocal motion to a deformed portion (11) of a diaphragm (7). The driving body (33) includes a shaft portion (36) including a shaft hole (43) in which a driving shaft (32) fixed to the crank body is rotatably fitted. The shaft hole is a non-through hole including an opening-side end (43*a*) and a closed-side end (43*b*) each including an inner peripheral surface that contacts the driving shaft over a whole circumference. The shaft portion includes an oil storage (44) opening to a region between the opening-side end and the closed-side end of the shaft hole.

4 Claims, 3 Drawing Sheets

(51) Int. Cl.

| | |
|---|---|
| ***F04B 53/00*** | (2006.01) |
| ***F04B 35/04*** | (2006.01) |
| *F04B 39/00* | (2006.01) |

(56) References Cited

U.S. PATENT DOCUMENTS

| | | | | |
|---|---|---|---|---|
| 6,382,928 | B1 * | 5/2002 | Chang | F04B 43/026 417/269 |
| 6,716,005 | B2 * | 4/2004 | Yamakawa | F04B 43/026 417/521 |
| 6,843,643 | B2 * | 1/2005 | Fukami | F04B 43/026 137/855 |
| 7,040,876 | B2 * | 5/2006 | Fukami | F04B 43/026 417/413.1 |
| 9,341,176 | B2 * | 5/2016 | Itahara | F04B 43/02 |
| 9,822,773 | B2 * | 11/2017 | Douglas | F04B 43/04 |
| 9,920,753 | B2 * | 3/2018 | Douglas | F04B 43/021 |
| 10,107,279 | B2 * | 10/2018 | Dankbaar | F04B 1/14 |
| 10,253,768 | B2 * | 4/2019 | Yan | F04B 43/021 |
| 2008/0060515 | A1 | 3/2008 | Cho | |
| 2017/0074260 | A1 * | 3/2017 | Yan | F04B 43/021 |

FOREIGN PATENT DOCUMENTS

| | | | |
|---|---|---|---|
| JP | 2003-035267 | A | 2/2003 |
| JP | 2004-263596 | A | 9/2004 |
| JP | 2014-196679 | A | 10/2014 |

OTHER PUBLICATIONS

Office Action received for Chinese Patent Application No. 201810595460.1, dated Apr. 26, 2019, 14 pages (7 pages of English Translation and 7 pages of Office Action).

* cited by examiner

DIAPHRAGM PUMP

BACKGROUND OF THE INVENTION

The present invention relates to a diaphragm pump including a driving shaft fixed, in a tilting state, to a rotating crank body.

A diaphragm pump of this type is described in, for example, Japanese Patent Laid-Open No. 2014-196679 (literature 1). The diaphragm pump described in literature 1 includes a crank body fixed to the rotating shaft of a motor, a driving body connected to the crank body via a tilting driving shaft, a diaphragm connected to the driving body, and a suction valve and a discharge valve.

The crank body is located on the same axis as the rotating shaft of the motor. The driving shaft is fixed to the crank body in a state in which one end on the crank body side is decentered with respect to the axis of the rotating shaft of the motor, and the other end approaches the axis of the rotating shaft. The driving body includes a shaft portion connected to the driving shaft, and a plurality of arm portions extending from the shaft portion outward in the radial direction.

The shaft portion is formed by a bearing member including a shaft hole in which the driving shaft is rotatably fitted, and a boss that stores the bearing member. The shaft hole is a non-through hole that opens at one end of the bearing member facing the crank body.

An oil storage groove opening to the shaft hole is formed in the bearing member. The oil storage groove is filled with lubricating oil to lubricate a slidable contact portion between the driving shaft and the bearing member. The oil storage groove extends along the shaft hole in parallel to the axis of the driving shaft and opens to the other end of the bearing member. For this reason, the inner peripheral surface (a sliding surface on which the distal end of the driving shaft slides) of the closed-side end of the shaft hole located on the other end side of the bearing member is interrupted by the oil storage groove in the circumferential direction.

A deformed portion of the diaphragm is attached to each arm portion of the driving body. The deformed portion forms a part of the wall of a pump chamber. In the diaphragm pump disclosed in literature 1, when the crank body rotates together with the rotating shaft of the motor, the driving body converts the rotation into a reciprocal motion, thereby contracting or expanding the deformed portion. When the pump chamber contracts, the discharge valve opens and discharges a fluid in the pump chamber. On the other hand, when the deformed portion expands, the suction valve opens, and the fluid is sucked into the pump chamber.

As described above, the oil storage groove opens to the closed-side end of the shaft hole. For this reason, the circularity of the closed-side end lowers. When the circularity is low, the surface pressure of the contact portion between the shaft hole and the driving shaft is difficult to be constant. As a result, when the distal end of the driving shaft slides in the shaft hole while receiving the load of the pump, an oil film is interrupted at a portion where the surface pressure of the sliding portion becomes high, and wear progresses. For this reason, in the diaphragm pump disclosed in literature 1, the wear resistance may be low.

SUMMARY OF THE INVENTION

It is an object of the present invention to provide a diaphragm pump that has a high wear resistance while employing a structure capable of supplying lubricating oil to a sliding portion between a driving body and a driving shaft.

In order to achieve the above-described object, according to the present invention, there is provided a diaphragm pump comprising a diaphragm including a deformed portion that forms a part of a wall of a pump chamber, a crank body fixed to a rotating shaft of a motor, a driving shaft including one end fixed to a position of the crank body decentered from the rotating shaft and tilting with respect to the rotating shaft, a driving body configured to convert a rotation of the crank body into a reciprocal motion and transmit the reciprocal motion to the deformed portion, the driving body including a shaft portion including a shaft hole in which the driving shaft is rotatably fitted, and an arm portion projecting from the shaft portion outward in a radial direction and connected to the deformed portion, the shaft hole comprising a non-through hole including an opening-side end and a closed-side end each including an inner peripheral surface that contacts the driving shaft over a whole circumference, and the shaft portion including an oil storage opening to a region between the opening-side end and the closed-side end of the shaft hole, and a pump mechanism configured to alternately repeat a state in which a fluid is discharged from the pump chamber and a state in which the fluid is sucked into the pump chamber along with the reciprocal motion of the driving body.

DESCRIPTION OF THE PREFERRED EMBODIMENT

A diaphragm pump according to an embodiment of the present invention will now be described in detail with reference to FIGS. 1 to 3.

Figure 1:
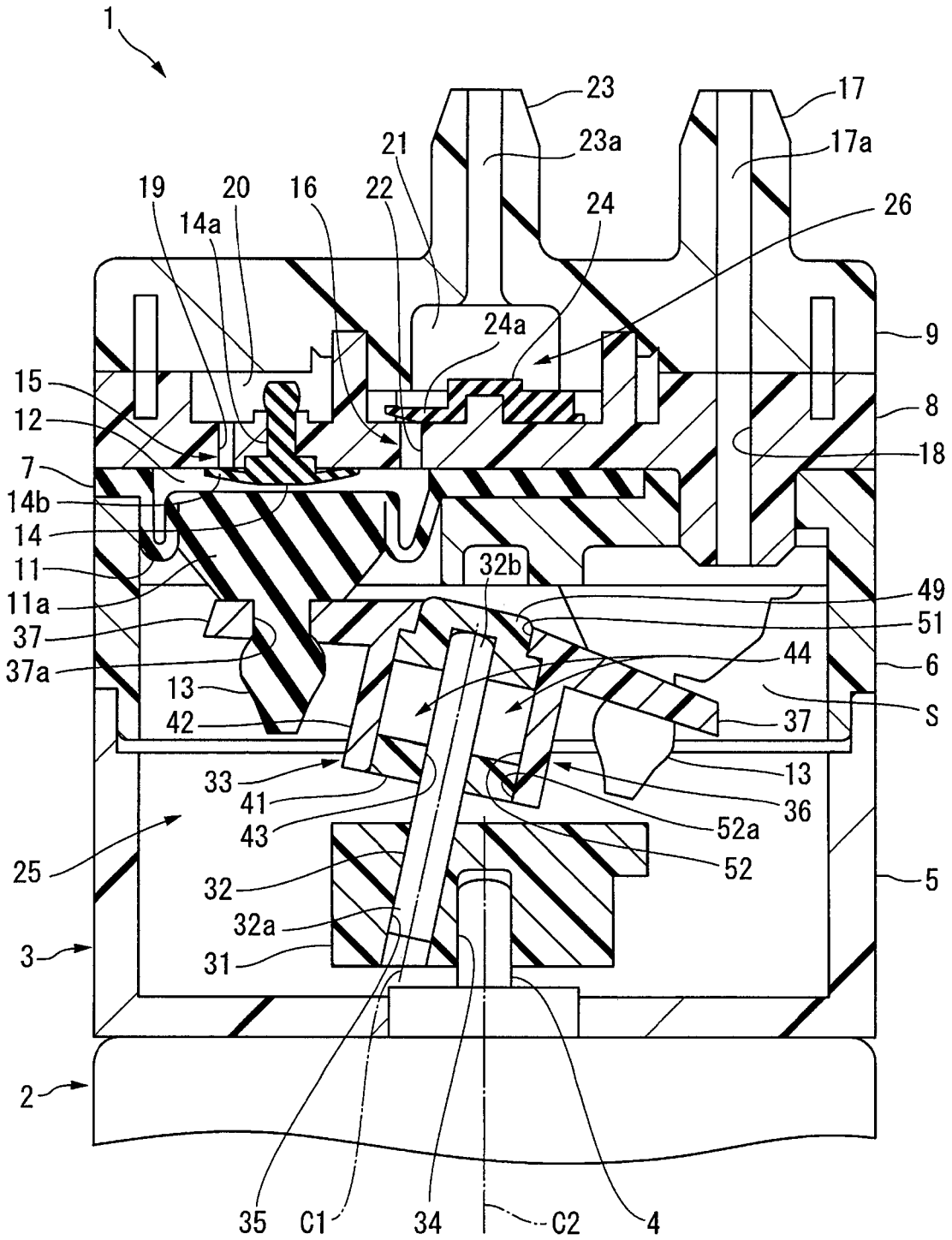
FIG. 1 is a sectional view of a diaphragm pump according to an embodiment of the present invention.

A diaphragm pump 1 shown in FIG. 1 is attached to a motor 2 located at the lowermost position in FIG. 1, and operates by being driven by the motor 2. The diaphragm pump 1 is a pump that sucks air and discharges it. In this embodiment, the air corresponds to "fluid" in the present invention.

The diaphragm pump 1 includes a housing 3 fixed to the motor 2. Functional components that form the diaphragm pump 1 are held by the housing 3. The housing 3 is formed into a columnar shape by combining a plurality of members in the axial direction of the motor 2, and located on the same axis as a rotating shaft 4 of the motor 2. The plurality of members that form the housing 3 are a bottom body 5 having a cylindrical shape with a closed bottom and attached to the motor 2, a diaphragm holder 6 attached to the opening portion of the bottom body 5, a disc-shaped valve holder 8 attached to the diaphragm holder 6, a lid body 9 attached in a state in which it is overlaid on the valve holder 8, and the like.

A diaphragm 7 is held while being sandwiched between the diaphragm holder 6 and the valve holder 8. In addition, the diaphragm 7 includes a plurality of cup-shaped deformed portions 11 that open toward the valve holder 8. The deformed portions 11 are provided at positions to divide the diaphragm 7 into a plurality of parts in the circumferential direction of the housing 3.

The opening portions of the deformed portions 11 are closed by the valve holder 8. A plurality of pump chambers 12 are formed between the valve holder 8 and the plurality of deformed portions 11. For this reason, the deformed portions 11 form parts of the walls of the pump chambers 12. A bottom wall 11*a* of each deformed portion 11 having a cup shape is provided with a connecting piece 13 that projects toward a direction to separate from the pump chamber 12.

In a portion of the valve holder 8, which forms the wall of each pump chamber 12, a suction valve 14 is provided, and a suction passage 15 and a discharge passage 16 open. The suction valve 14 is made of a rubber material and provided for each pump chamber 12. The suction valve 14 includes a shaft portion 14*a* extending through the valve holder 8 and fixed to the valve holder 8, and a valve body 14*b* in tight contact with to the wall surface of the valve holder 8 on the side of the pump chamber 12.

The suction passage 15 is formed by connecting a plurality of holes, spaces, and the like. The upstream end of the suction passage 15 is formed by a suction pipe 17 provided on the outer peripheral portion of the lid body 9. An inner passage 17*a* of the suction pipe 17 communicates with a space S in the diaphragm holder 6 via a first through hole 18 of the valve holder 8. On the other hand, the downstream end of the suction passage 15 is formed by a second through hole 19 extending through the valve holder 8 in a state in which one end opens to the pump chamber 12.

The second through hole 19 makes a suction fluid chamber 20 formed between the valve holder 8 and the lid body 9 communicate with the pump chamber 12. The suction fluid chamber 20 is connected to the above-described space S via a fluid passage (not shown). Although not illustrated in detail, the suction fluid chamber 20 is formed into an annular shape located on the same axis as the housing 3 and communicates with each pump chamber 12 via the second through hole 19 of each pump chamber 12. The opening portion of the second through hole 19 on the side of the pump chamber 12 is closed by the valve body 14*b* of the suction valve 14.

The discharge passage 16 is formed by a discharge fluid chamber 21, a third through hole 22, and a discharge pipe 23. The discharge fluid chamber 21 is formed at the axial portion of the housing 3 between the valve holder 8 and the lid body 9. The third through hole 22 is formed in the valve holder 8 such that the discharge fluid chamber 21 and the pump chamber 12 communicate with each other. The discharge pipe 23 is projected at the axial portion of the lid body 9, and an internal space 23*a* of the discharge pipe 23 is connected to the discharge fluid chamber 21. A discharge valve 24 is provided in the discharge fluid chamber 21. The discharge valve 24 is made of a rubber material and includes a valve body 24*a* in tight contact with the wall surface of the valve holder 8 on the side of the discharge fluid chamber 21. The valve body 24*a* closes the opening portion of the third through hole 22.

The discharge valve 24 and the above-described suction valve 14 open/close in accordance with an increase/decrease in the volume of the pump chamber 12. The discharge valve 24 opens in a contraction process in which the volume of the pump chamber 12 decreases, and is closed otherwise. The suction valve 14 opens in an expansion process in which the volume of the pump chamber 12 increases, and is closed otherwise. The volume of the pump chamber 12 changes when the deformed portion 11 of the diaphragm 7 is pushed or pulled by a driving mechanism 25 to be described later.

In this embodiment, a pump mechanism 26 is formed by the suction valve 14 and the discharge valve 24, the suction pipe 17, the first through hole 18, the space S, the fluid passage (not shown), the suction fluid chamber 20, the second through hole 19, the third through hole 22, the discharge fluid chamber 21, the discharge pipe 23, and the like.

The driving mechanism 25 includes a crank body 31 attached to the rotating shaft 4 of the motor 2, a driving body 33 connected to the crank body 31 via a driving shaft 32, and the like. The crank body 31 is formed into a columnar shape, and a first shaft hole 34 formed from a non-through hole is formed in the axial portion. The rotating shaft 4 is press-fitted in the first shaft hole 34. For this reason, the crank body 31 is fixed to the rotating shaft 4 and rotates integrally with the rotating shaft 4. The crank body 31 and the driving body 33 are made of a plastic material. The driving shaft 32 is made of a metal material.

One end 32*a* of the driving shaft 32 on the side of the crank body 31 is fixed at a position of the crank body 31 decentered from the rotating shaft 4, and the driving shaft 32 is supported by the crank body 31. An axis C1 of the driving shaft 32 tilts in a predetermined direction with respect to an axis C2 of the rotating shaft 4. Fixing of the driving shaft 32 to the crank body 31 is done by press-fitting the one end 32*a* of the driving shaft 32 into a second shaft hole 35 formed in the crank body 31. The tilting direction of the driving shaft 32 is a direction in which the decentering amount with respect to the rotating shaft 4 becomes small at the other end 32*b* of the driving shaft 32.

The driving body 33 is formed by a columnar shaft portion 36 to which the driving shaft 32 is connected, and a plurality of arm portions 37 projecting from the shaft portion 36 outward in the radial direction. The shaft portion 36 includes a columnar bearing member 41 to which the driving shaft 32 is connected, and a tubular member 42 that stores the bearing member 41. The bearing member 41 is bonded to the tubular member 42 by an adhesive (not shown).

A third shaft hole 43 formed from a non-through hole opening toward the crank body 31 is formed in the axial portion of the bearing member 41. The third shaft hole 43 includes an opening-side end 43*a* and a closed-side end 43*b*. In this embodiment, the third shaft hole 43 corresponds to "shaft hole" in the present invention. The driving shaft 32 is inserted from the other end 32*b* into the third shaft hole 43 and rotatably fitted in the third shaft hole 43.

Figure 2:
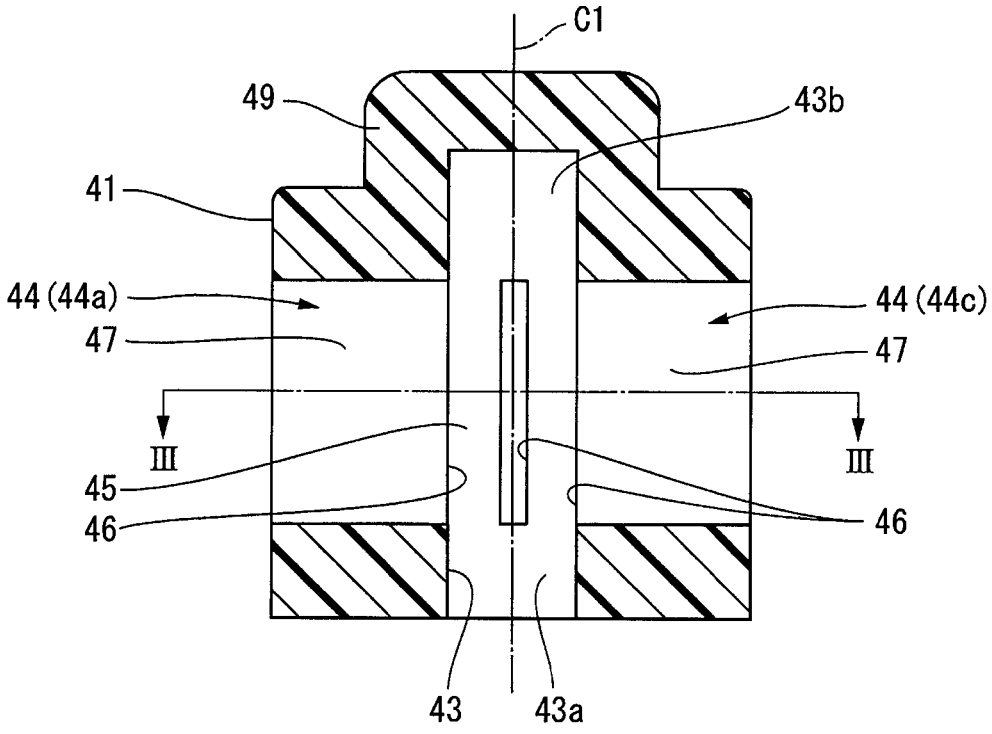
FIG. 2 is a longitudinal sectional view of a bearing member.
Figure 3:
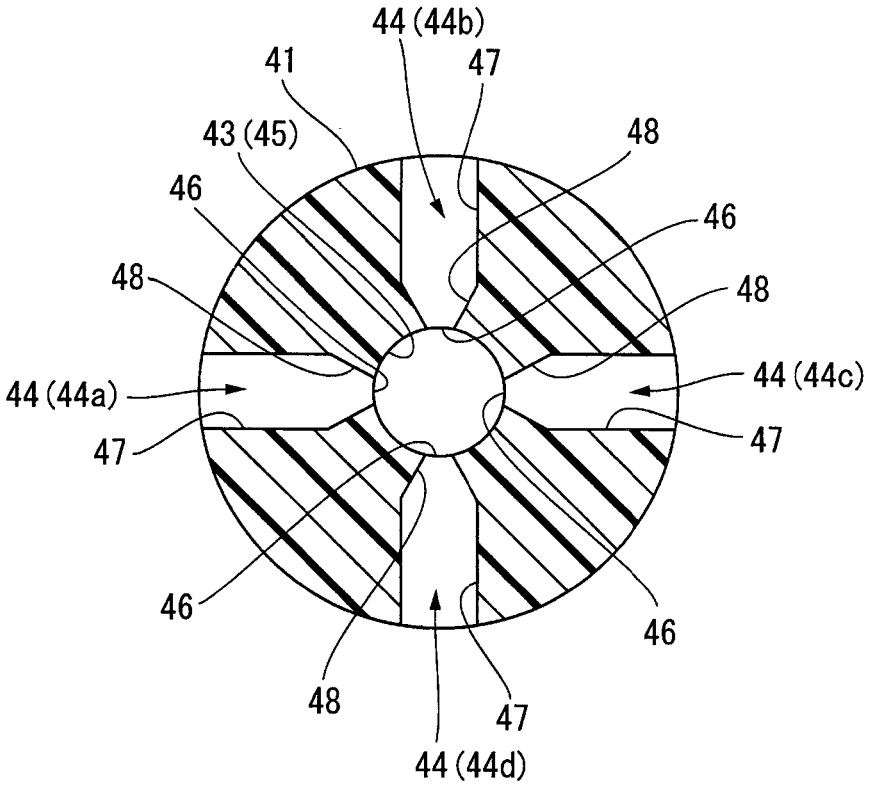
FIG. 3 is a cross-sectional view of the bearing member whose cutting position in FIG. 3 is a position indicated by a line III-III in FIG. 2.

As shown in FIGS. 2 and 3, four oil storage portions 44*a* to 44*d* are formed at the central portion of the bearing member 41 in the axial direction. The oil storage portions 44*a* to 44*d* are arranged at a predetermined interval in the circumferential direction of an inner peripheral surface 45 of the third shaft hole 43. The oil storage portions 44*a* to 44*d* will representatively be referred to as an "oil storage portion 44" hereinafter. The oil storage portion 44 includes a supply port 46 opening to the inner peripheral surface 45 of the third shaft hole 43, and a storage portion 47 extending from the supply port 46 in a direction orthogonal to an axis C of the driving shaft 32. The oil storage portion 44 is filled with lubricating oil (not shown).

The supply port 46 is formed into a slit shape having a predetermined opening width and extending in the axial direction of the driving shaft 32. The position in the axial direction where the supply port 46 opens is located between the opening-side end 43*a* and the closed-side end 43*b* of the third shaft hole 43. That is, the oil storage portion 44 opens only to the region between the opening-side end 43*a* and the closed-side end 43*b* of the third shaft hole 43 and does not open to the opening-side end 43*a* and the closed-side end 43*b*. For this reason, the inner peripheral surface 45 of each of the opening-side end 43*a* and the closed-side end 43*b* of the third shaft hole 43 exists without being interrupted in the circumferential direction. In other words, each of the opening-side end 43*a* and the closed-side end 43*b* has the inner peripheral surface 45 that continues and contacts the driving shaft 32 over the whole circumference.

The storage portion 47 is formed by a hole having one end connected to the supply port 46 and other end opening to the outer peripheral surface of the bearing member 41. The storage portion 47 has the same length as the supply port 46 in the axial direction of the driving shaft 32. The opening width of the storage portion 47 in the circumferential direction of the third shaft hole 43 is constant except in a connecting portion 48 (see FIG. 3) between the storage portion 47 and the supply port 46. The opening width of the connecting portion 48 gradually decreases toward the supply port 46.

An end of the bearing member 41 on a side far apart from the crank body 31 includes a circular projecting portion 49 (see FIG. 2) whose outer diameter is smaller than that of the remaining portion.

The tubular member 42 is formed into a cylindrical shape in which the bearing member 41 is fitted. More specifically, the tubular member 42 includes a small-diameter hole 51 in which the circular projecting portion 49 of the bearing member 41 is fitted, and a large-diameter hole 52 in which the remaining portion of the bearing member 41 is fitted, as shown in FIG. 1. When the bearing member 41 is fitted in the tubular member 42, the openings of the storage portions 47, which are formed in the outer peripheral surface of the bearing member 41, are closed by an inner peripheral surface 52*a* of the large-diameter hole 52 of the tubular member 42. As a result, the oil storage portions 44 each having an opening only at the supply port 46 are formed in the shaft portion 36.

The plurality of arm portions 37 are integrally formed at an end of the tubular member 42 on the side far apart from the crank body 31. The arm portions 37 are provided for the deformed portions 11 of the diaphragm 7, respectively, and extend from the tubular member 42 radially outward in the radial direction. A through hole 37*a* is formed in each arm portion 37. The connecting piece 13 of the diaphragm 7 is engaged in the through hole 37*a*. The connecting piece 13 is fixed to the arm portion 37 in a state in which the connecting piece 13 extends through the arm portion 37. Hence, the plurality of arm portions 37 are connected to the plurality of deformed portions 11 of the diaphragm 7, respectively.

In the thus configured diaphragm pump 1, when the rotating shaft 4 of the motor 2 rotates, the crank body 31 and the driving shaft 32 rotate about the rotating shaft 4. At this time, the driving body 33 swings along with a change in the tilting direction of the driving shaft 32 because the rotation of the driving body 33 is restricted by the diaphragm 7. By this swing, the arm portion 37 push or pull the deformed portion 11. For this reason, the driving body 33 converts the rotation of the rotating shaft 4 and the crank body 31 into a reciprocal motion and transmits it to the deformed portion 11.

When the deformed portion 11 of the diaphragm 7 is pulled by the arm portion 37 to the side of the motor 2 and expands, the volume of the pump chamber 12 increases, the suction valve 14 opens, and air is sucked from the suction pipe 17 into the pump chamber 12 via the suction passage 15. On the other hand, when the deformed portion 11 of the diaphragm 7 is pushed by the arm portion 37 to the side of the valve holder 8, the deformed portion 11 contracts, the volume of the pump chamber 12 decreases, the discharge valve 24 opens, and the air in the pump chamber 12 is discharged from the discharge pipe 23 via the discharge passage 16. When the crank body 31 continuously rotates, and the driving body 33 makes a reciprocal motion, the state in which the air is discharged from the pump chamber 12 and the state in which the air is sucked into the pump chamber 12 are alternately repeated in the pump mechanism 26.

At the time of the pump operation, the driving shaft 32 rotates while being in contact with the inner peripheral surface 45 of the third shaft hole 43. That is, the driving shaft 32 slides against the third shaft hole 43. The plurality of oil storage portions 44 open to the third shaft hole 43. For this reason, the lubricating oil stored in the storage portions 47 of the oil storage portions 44 can be supplied from the supply ports 46 to the sliding portion between the third shaft hole 43 and the driving shaft 32.

Since at each of the opening-side end 43*a* and the closed-side end 43*b* of the third shaft hole 43, the inner peripheral surface 45 exists over the whole region in the circumferential direction without being interrupted in the circumferential direction, the circularity is kept high. For this reason, when the distal end (other end 32*b*) of the driving shaft 32 slides while receiving the load of the pump at the time of actuation of the pump, an oil film can be prevented from being interrupted between the two ends (32*a* and 32*b*) of the driving shaft 32 and the third shaft hole 43. Hence, according to this embodiment, it is possible to provide the diaphragm pump 1 having a high wear resistance in the sliding portion between the driving shaft 32 and the third shaft hole 43.

The oil storage portion 44 according to this embodiment includes the supply port 46 formed into a slit shape having a predetermined opening width and extending in the axial direction of the driving shaft 32 and opening to the third shaft hole 43, and the storage portion 47 extending from the supply port 46 in the direction orthogonal to the axis C1 of the driving shaft 32. The opening width of the connecting portion 48 of the storage portion 47 with the supply port 46 gradually decreases toward the supply port 46. For this reason, the supply port 46 can be made as small as possible while ensuring a large volume of the storage portion 47. Hence, the circularity of a portion of the third shaft hole 43 where the supply port 46 opens hardly lowers. In addition, it is possible to supply, from the supply port 46, a small amount of lubricating oil in a necessary minimum supply amount. As a result, the wear resistance of the sliding portion between the third shaft hole 43 and the driving shaft 32 becomes higher.

The shaft portion 36 of the driving body 33 according to this embodiment includes the bearing member 41 in which the third shaft hole 43 and the oil storage portions 44 are formed, and the tubular member 42 that is connected to the arm portions 37 and stores the bearing member 41. Each storage portion 47 includes an opening formed in the outer peripheral surface of the bearing member 41, and the opening is closed by the inner peripheral surface 52*a* of the tubular member 42. For this reason, the storage portion 47 is formed in the bearing member 41 as a through hole extending from the third shaft hole 43 to the outer peripheral surface of the bearing member 41. When the bearing member 41 including the storage portions 47 is stored in the tubular member 42, the oil storage portions 44 each having an opening only at the supply port 46 are formed in the shaft portion 36. Hence, since the oil storage portions 44 can easily be formed in the shaft portion 36, the diaphragm pump 1 including the oil storage portions 44 can be provided inexpensively.

In this embodiment, the plurality of oil storage portions 44 are arranged at a predetermined interval in the circumferential direction of the inner peripheral surface 45 of the third shaft hole 43. For this reason, since a large amount of lubricating oil can be stored, the lubricating oil can be supplied for a long period, and the wear resistance can further be improved.

Note that in the above-described embodiment, an example in which four oil storage portions 44 are provided in the bearing member 41 has been described. However, the number of oil storage portions 44 can be changed as needed. That is, it is possible to provide one oil storage portion 44 or two or more oil storage portions 44 in the bearing member 41. Additionally, in the above-described embodiment, an example in which the diaphragm pump 1 sucks air and discharges it has been described. However, the present invention is also applicable to a pump that sucks a fluid such as a liquid and discharges it.

What is claimed is:

1. A diaphragm pump comprising:

a diaphragm including a deformed portion that forms a part of a wall of a pump chamber;

a crank body fixed to a rotating shaft of a motor;

a driving shaft including one end fixed to a position of the crank body decentered from the rotating shaft and tilting with respect to the rotating shaft;

a driving body configured to convert a rotation of the crank body into a reciprocal motion and transmit the reciprocal motion to the deformed portion, the driving body including a shaft portion including a shaft hole in which the driving shaft is rotatably fitted, and an arm portion projecting from the shaft portion outward in a radial direction and connected to the deformed portion, the shaft hole comprising a non-through hole including an opening-side end and a closed-side end each including an inner peripheral surface that contacts the driving shaft over a whole circumference, and the shaft portion including an oil storage that opens to a region between the opening-side end and the closed-side end of the shaft hole, the oil storage including an end closed to an outward direction in the radial direction; and a pump mechanism configured to alternately repeat a state in which a fluid is discharged from the pump chamber and a state in which the fluid is sucked into the pump chamber along with the reciprocal motion of the driving body.

2. The pump according to claim 1, wherein the oil storage includes:

a supply port formed into a slit shape having a predetermined opening width and extending in an axial direction of the driving shaft and opening to the shaft hole; and a storage portion extending from the supply port in a direction orthogonal to the axial direction of the driving shaft, and wherein a connecting portion of the storage portion with the supply port gradually becomes narrow toward the supply port.

3. The pump according to claim 2, wherein the shaft portion includes:

a bearing member in which the shaft hole and the oil storage are formed; and a tubular member that is connected to the arm portion and stores the bearing member, wherein the storage portion includes an opening portion formed in an outer peripheral surface of the bearing member, and wherein the opening portion is closed by an inner surface of the tubular member.

4. The pump according to claim 1, wherein the oil storage includes a plurality of oil storage portions arranged at a predetermined interval in a circumferential direction of an inner peripheral surface of the shaft hole.

* * * * *